US011459633B2

(12) United States Patent
Takenaka et al.

(10) Patent No.: US 11,459,633 B2
(45) Date of Patent: Oct. 4, 2022

(54) LOW-IRON-LOSS GRAIN-ORIENTED ELECTRICAL STEEL SHEET AND PRODUCTION METHOD FOR SAME

(71) Applicant: JFE Steel Corporation, Tokyo (JP)

(72) Inventors: Masanori Takenaka, Tokyo (JP); Makoto Watanabe, Tokyo (JP); Yuiko Ehashi, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 211 days.

(21) Appl. No.: 16/957,461

(22) PCT Filed: Dec. 27, 2018

(86) PCT No.: PCT/JP2018/048084
§ 371 (c)(1),
(2) Date: Jun. 24, 2020

(87) PCT Pub. No.: WO2019/131853
PCT Pub. Date: Jul. 4, 2019

(65) Prior Publication Data

US 2020/0325555 A1 Oct. 15, 2020

(30) Foreign Application Priority Data

Dec. 28, 2017 (JP) ..... JP2017-253085

(51) Int. Cl.

| | |
|---|---|
| ***C21D 9/46*** | (2006.01) |
| ***C21D 1/34*** | (2006.01) |
| ***C21D 6/00*** | (2006.01) |
| ***C21D 8/00*** | (2006.01) |
| ***C21D 8/12*** | (2006.01) |
| ***C22C 38/00*** | (2006.01) |
| ***C22C 38/04*** | (2006.01) |
| ***C22C 38/06*** | (2006.01) |
| ***C22C 38/20*** | (2006.01) |
| ***C22C 38/22*** | (2006.01) |
| ***C22C 38/24*** | (2006.01) |
| ***C22C 38/32*** | (2006.01) |
| ***C22C 38/34*** | (2006.01) |
| ***C22C 38/48*** | (2006.01) |
| ***C22C 38/50*** | (2006.01) |
| ***C22C 38/60*** | (2006.01) |
| ***H01F 1/147*** | (2006.01) |

(52) U.S. Cl.

CPC ..... *C21D 9/46* (2013.01); *C21D 1/34* (2013.01); *C21D 6/004* (2013.01); *C21D 6/005* (2013.01); *C21D 6/008* (2013.01); *C21D 8/005* (2013.01); *C21D 8/1255* (2013.01); *C21D 8/1272* (2013.01); *C22C 38/002* (2013.01); *C22C 38/04* (2013.01); *C22C 38/06* (2013.01); *C22C 38/20* (2013.01); *C22C 38/22* (2013.01); *C22C 38/24* (2013.01); *C22C 38/32* (2013.01); *C22C 38/34* (2013.01); *C22C 38/48* (2013.01); *C22C 38/50* (2013.01); *C22C 38/60* (2013.01); *H01F 1/147* (2013.01); *C22C 2202/02* (2013.01)

(58) Field of Classification Search
None
See application file for complete search history.

(56) References Cited

U.S. PATENT DOCUMENTS

| | | | |
|---|---|---|---|
| 3,932,234 | A | 1/1976 | Imanaka et al. |
| 5,718,775 | A | 2/1998 | Komatsubara et al. |
| 2012/0013430 | A1 | 1/2012 | Morishige et al. |
| 2013/0000786 | A1 | 1/2013 | Murakami et al. |
| 2013/0174940 | A1 | 7/2013 | Cicale et al. |
| 2017/0335425 | A1 | 11/2017 | Joo et al. |
| 2018/0030558 | A1 | 2/2018 | Okubo et al. |

FOREIGN PATENT DOCUMENTS

| | | | |
|---|---|---|---|
| CN | 107002204 | A | 8/2017 |
| CN | 107208171 | A | 9/2017 |
| EP | 1818420 | A1 | 8/2007 |
| EP | 2412831 | A1 | 2/2012 |
| EP | 2548977 | A1 | 1/2013 |
| JP | 4015644 | | 4/1963 |
| JP | 5113469 | B2 | 4/1976 |

(Continued)

OTHER PUBLICATIONS

Chinese Office Action for Chinese Application No. 201880077387.7, dated Apr. 16, 2021 with English Search Report, 7 pages.
Extended European Search Report for European Application No. 18 894 953.1, dated Sep. 28, 2020, 7 pages.
International Search Report and Written Opinion for International Application No. PCT/JP2018/048084, dated Apr. 9, 2019, 5 pages.

*Primary Examiner* — Jenny R Wu
(74) *Attorney, Agent, or Firm* — RatnerPrestia

(57) ABSTRACT

In a production of a grain-oriented electrical steel sheet by subjecting a steel slab containing a particular composition and further including an inhibitor-forming ingredient to hot rolling, hot-band annealing, cold rolling, primary recrystallization annealing combined with decarburization annealing and finish annealing, the steel slab satisfies a given relation between a content ratio of sol. Al to N and a final sheet thickness, and, in the finish annealing, the steel sheet is kept at a temperature zone of higher than 850° C. but not higher than 950° C. in heating process for 5 to 200 hours, heated to a temperature zone of 950 to 1050° C. at 5 to 30° C./hr and further subjected to purification treatment of keeping a temperature of not lower than 1100° C. for not less than 2 hours to provide a secondary recrystallization structure that has an average value of a diameter equivalent to a circle of 10 to 100 mm.

20 Claims, 1 Drawing Sheet

(56) References Cited

FOREIGN PATENT DOCUMENTS

| | | | |
|---|---|---|---|
| JP | 04341518 | A | 11/1992 |
| JP | 0625747 | A | 2/1994 |
| JP | 07017956 | B | 3/1995 |
| JP | 0742507 | B2 | 5/1995 |
| JP | 08288115 | A | 11/1996 |
| JP | 09143637 | A | 6/1997 |
| JP | 10183249 | A | 7/1998 |
| JP | 2006274405 | A | 10/2006 |
| JP | 2013047382 | A | 3/2013 |
| JP | 2014062305 | A | 4/2014 |
| WO | 2010110217 | A1 | 9/2010 |
| WO | 2011115120 | A1 | 9/2011 |

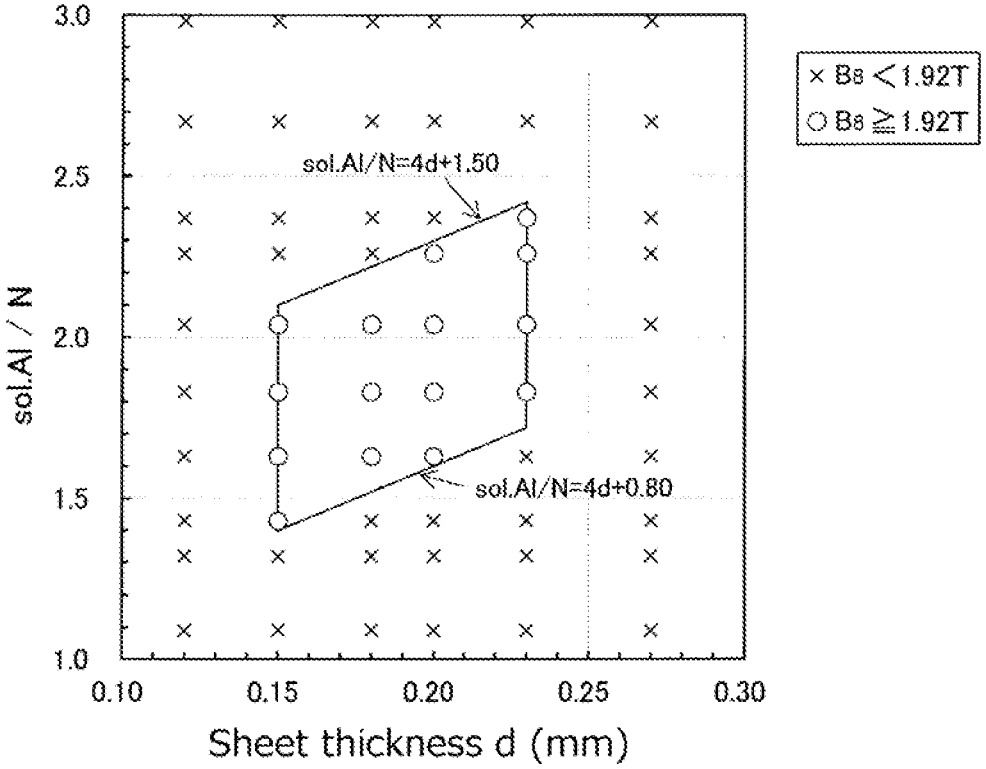
3.0
2.5
2.0
1.5
1.0
sol.Al / N
0.10
0.15
0.20
0.25
0.30
Sheet thickness d (mm)
sol.Al/N=4d+1.50
sol.Al/N=4d+0.80
× B8 < 1.92T
○ B8 ≧ 1.92T

LOW-IRON-LOSS GRAIN-ORIENTED ELECTRICAL STEEL SHEET AND PRODUCTION METHOD FOR SAME

CROSS REFERENCE TO RELATED APPLICATIONS

This is the U.S. National Phase application of PCT/JP2018/048084, filed Dec. 27, 2018, which claims priority to Japanese Patent Application No. 2017-253085, filed Dec. 28, 2017, the disclosures of these applications being incorporated herein by reference in their entireties for all purposes.

FIELD OF THE INVENTION

This invention relates to a low-iron-loss grain-oriented steel sheet and a method for producing the same.

BACKGROUND OF THE INVENTION

A grain-oriented electrical steel sheet is a soft magnetic material having excellent magnetic properties such as low iron loss and a high magnetic flux density obtained by accumulating crystal grains into {110}<001> orientation (hereinafter referred to as "Goss orientation") through secondary recrystallization, and thus mainly used as an iron core material of an electric instrument such as transformer and the like. As an indication of the magnetic properties of the grain-oriented electrical steel sheet is generally used a magnetic flux density $B_8$ (T) at a magnetic field intensity of 800 A/m and an iron loss $W_{17/50}$ (W/kg) per 1 kg of steel sheet in a magnetization up to 1.7 T under an alternating current magnetic field at an excitation frequency of 50 Hz.

The iron loss of the grain-oriented electrical steel sheet is represented by the sum of a hysteresis loss which depends on the crystal orientation, purity of steel sheet and the like, and an eddy current loss which depends on the sheet thickness, specific resistance, magnetic domain size and the like. Therefore, as a method for reducing the iron loss are known a method for reducing the hysteresis loss by increasing an accumulation degree of the crystal orientation into Goss orientation so as to increase the magnetic flux density, a method for reducing the eddy current loss by increasing Si content and the like, which increase an electric resistance, decreasing a thickness of the steel sheet, subdividing magnetic domain, and so on.

A typical method of increasing the magnetic flux density among these methods for reducing the iron loss includes a method of preferentially growing only Goss orientation by utilizing precipitates called as inhibitor in the production of the grain-oriented electrical steel sheet to provide mobility difference to the grain boundary during the final finish annealing. For example, Patent Literature 1 discloses a method of using AlN and MnS as an inhibitor, and Patent Literature 2 discloses a method of using MnS and MnSe as an inhibitor. Those methods have been industrially put in practical use as a production method that needs slab heating at a high temperature.

There are two methods of decreasing the sheet thickness: a method by rolling and a method by chemical polishing. The method by chemical polishing, in which the yield is largely decreased, is not suitable in the industrial-scale production. Therefore, the method by rolling is exclusively used to decrease the sheet thickness. However, when the sheet thickness is decreased by rolling, there is a problem that secondary recrystallization in finish annealing is unstable to make it difficult to stably produce a product having excellent magnetic properties.

To solve the problem, for example, Patent Literature 3 discloses that a method for producing a thin grain-oriented electrical steel sheet by using AlN as a main inhibitor and performing a final cold rolling under a strong pressure in which a more excellent iron loss value can be obtained by adding Cu and/or Sb in addition to the composite addition of Sn and Se. Patent Literature 4 discloses that a method for producing a thin grain-oriented electrical steel sheet having a sheet thickness of not more than 0.20 mm in which Nb is added to promote fine dispersion of carbonitride and strengthen the inhibitor effect, whereby the magnetic properties are improved. Patent Literature 5 discloses a method of producing a thin grain-oriented electrical steel sheet having excellent magnetic properties through a single cold rolling only, by decreasing the sheet thickness of a hot-rolled sheet to lower a coiling temperature and controlling a heat pattern in finish annealing to a proper level. Further, Patent Literature 6 discloses a method of producing a grain-oriented electrical steel sheet of not more than 0.23 mm by using a single cold rolling method by making a sheet thickness of a hot-rolled sheet not more than 1.9 mm.

However, an ultra-thin grain-oriented electrical steel sheet having a sheet thickness of 0.15 to 0.23 mm after the final cold rolling has a problem that poor secondary recrystallization is caused to easily lower the yield even when the techniques of Patent Literatures 3 to 6 are applied.

As a method to solve the above problems, Patent Literature 7 discloses a technique for preventing the poor secondary recrystallization by controlling a content ratio of sol. Al to N in a steel slab as a raw material in accordance with the sheet thickness of a product so that the grain size of primary recrystallized grains in the central layer of the steel sheet thickness has a size suitable for the secondary recrystallization while subjecting the steel sheet before the secondary recrystallization to a keeping treatment for keeping the steel sheet at a given temperature for a given time to uniformize a temperature in a coil and then conducting rapid heating at a heating rate of 10 to 60° C./hr to control the grain size in the surface layer of the steel sheet within a proper range.

PATENT LITERATURE

Patent Literature 1: JP-B-S40-015644
Patent Literature 2: JP-B-S51-013469
Patent Literature 3: JP-B-H07-017956
Patent Literature 4: JP-A-H06-025747
Patent Literature 5: JP-B-H07-042507
Patent Literature 6: JP-A-H04-341518
Patent Literature 7: JP-A-2013-047382

SUMMARY OF THE INVENTION

In the ultra-thin grain-oriented electrical steel sheets having a product sheet thickness (final cold-rolled sheet thickness) of 0.15 to 0.23 mm, however, even when the steel sheet before the secondary recrystallization is subjected to the keeping treatment in a heating process of finish annealing by applying the technique disclosed in Patent Literature 7, a large temperature difference is caused in the coil in the subsequent rapid heating for causing the secondary recrystallization, and hence poor secondary recrystallization is still caused especially in a site where the heating rate is relatively slow such as a middle portion of the coil or the like. Therefore, the technique is not a fundamental solution of the problem. Also, a powerful heating device and a large amount of fuel supply are necessary to perform the rapid heating at a high temperature zone after the keeping treatment, which is unfavorable in view of an industrial standpoint.

Aspects of the invention are made in view of the above problems inherent to the prior arts, and the object thereof is to propose a method for producing a grain-oriented electrical steel sheet that requires a high-temperature heating of a slab, in which poor secondary recrystallization can be suppressed without conducting rapid heating in finish annealing even for an ultra-thin sheet thickness.

The inventors have made various studies to solve the above task, focusing on a relation between sol. Al and N contents as an inhibitor forming component and a product sheet thickness. As a result, they have found that a value of the ratio of sol. Al content to N content (sol. Al/N) in a steel slab as a raw material with respect to the product sheet thickness is controlled to a range lower than the value in the prior art disclosed in Patent Literature 7, whereby Ostwald growth of AlN as acting as an inhibitor is suppressed in the finish annealing, and primary recrystallized grains before the secondary recrystallization has a size suitable for the secondary recrystallization, and the proper heating rate after the keeping treatment in the heating process of the finish annealing is shifted to a range lower than the prior art disclosed in Patent Literature 7, and hence the secondary recrystallization can be developed stably over a full length of the coil without conducting rapid-heating. Thus, aspects of the invention have been accomplished.

Aspects of the invention based on the above knowledge include a grain-oriented electrical steel sheet having a chemical composition comprising C: not more than 0.005 mass %, Si: 2.0 to 5.0 mass %, Mn: 0.01 to 0.30 mass % and the residue being Fe and inevitable impurity, and a secondary recrystallization structure that has an average value of the diameter equivalent to a circle of crystal grains of 10 to 100 mm, an average value of an aspect ratio represented by (length in the rolling direction)/(length in the direction perpendicular to the rolling direction) of less than 2.0, and a standard deviation of the aspect ratio of not more than 1.0.

The grain-oriented electrical steel sheet according to aspects of the invention is characterized in that the standard deviation of the aspect ratio of the crystal grains is not more than 0.7.

Also, the grain-oriented electrical steel sheet according to aspects of the invention is characterized in that the total area ratio of crystal grains having a diameter equivalent to a circle of less than 2 mm is not more than 1%.

Further, the grain-oriented electrical steel sheet according to aspects of the invention is characterized by containing one or more selected from Ni: 0.01 to 1.00 mass %, Sb: 0.005 to 0.50 mass %, Sn: 0.005 to 0.50 mass %, Cu: 0.01 to 0.50 mass %, Cr: 0.01 to 0.50 mass %, P: 0.005 to 0.50 mass %, Mo: 0.005 to 0.10 mass %, Ti: 0.001 to 0.010 mass %, Nb: 0.001 to 0.010 mass %, V: 0.001 to 0.010 mass %, B: 0.0002 to 0.0025 mass %, Bi: 0.005 to 0.50 mass %, Te: 0.0005 to 0.010 mass % and Ta: 0.001 to 0.010 mass %, in addition to the above chemical composition.

Aspects of the invention also include a production method for a grain-oriented electrical steel sheet comprising a series of processes of:

heating a steel slab having a chemical composition comprising C: 0.02 to 0.10 mass %, Si: 2.0 to 5.0 mass %, Mn: 0.01 to 0.30 mass %, sol. Al: 0.01 to 0.04 mass %, N: 0.004 to 0.020 mass %, one or two selected from S and Se: 0.002 to 0.040 mass % in total and the residue being Fe and inevitable impurity to not lower than 1250° C., and subjecting the steel slab to hot rolling, a single cold rolling or two or more cold rollings including an intermediate annealing therebetween to provide a cold-rolled sheet with a final sheet thickness, primary recrystallization annealing combined with decarburization annealing, and finish annealing, characterized in that the steel slab has a content ratio of sol. Al to N (sol. Al/N) and a final sheet thickness d (mm) satisfying the following equation (1):

$$4d+0.80 \leq \text{sol. Al/N} \leq 4d+1.50 \quad (1),$$

and the finish annealing is conducted by keeping the sheet at a temperature zone of higher than 850° C. but not higher than 950° C. in a heating process for 5 to 200 hours, subsequently reheating or descending the temperature once to not higher than 700° C. followed by reheating, heating the sheet in a temperature zone from 950 to 1050° C. at a heating rate of 5 to 30° C./hr, and further conducting a purification treatment of keeping a temperature of not lower than 1100° C. for not less than 2 hours.

The production method of the grain-oriented electrical steel sheet according to aspects of the invention is characterized in that the sheet is heated from 500° C. to 700° C. in the heating process of the primary recrystallization annealing at a heating rate of not less than 50° C./s.

In the production method of the grain-oriented electrical steel sheet according to aspects of the invention, the steel slab is characterized by containing one or more selected from Ni: 0.01 to 1.00 mass %, Sb: 0.005 to 0.50 mass %, Sn: 0.005 to 0.50 mass %, Cu: 0.01 to 0.50 mass %, Cr: 0.01 to 0.50 mass %, P: 0.005 to 0.50 mass %, Mo: 0.005 to 0.10 mass %, Ti: 0.001 to 0.010 mass %, Nb: 0.001 to 0.010 mass %, V: 0.001 to 0.010 mass %, B: 0.0002 to 0.0025 mass %, Bi: 0.005 to 0.50 mass %, Te: 0.0005 to 0.010 mass % and Ta: 0.001 to 0.010 mass % in addition to the above chemical composition.

The production method of the grain-oriented electrical steel sheet according to aspects of the invention is characterized in that a magnetic domain subdividing treatment is performed in any of the steps after the cold rolling for rolling the sheet to the final sheet thickness.

The production method of the grain-oriented electrical steel sheet according to aspects of the invention is characterized in that the magnetic domain subdividing treatment is conducted by irradiating an electron beam or a laser beam onto the surface of the steel sheet after flattening annealing.

In a production method of a grain-oriented electrical steel sheet that performs a high-temperature slab heating, an ultra-thin steel sheet having a sheet thickness of 0.15 to 0.23 mm is difficult to develop sound secondary recrystallization. According to the production method in accordance with aspects of the invention, however, secondary recrystallization can be developed stably even in the ultra-thin steel sheet, so that an effect of improving an iron loss property obtained by the decrease in the sheet thickness can be obtained over a full length of the coil. According to aspects of the invention, also, rapid heating from 800 to 950° C. in the heating process of the finish annealing is not necessary, which is advantageous from the industrial viewpoint.

BRIEF DESCRIPTION OF THE DRAWINGS

The FIGURE is a graph showing an influence of (sol. Al/N) in a steel slab and a sheet thickness d upon a magnetic flux density Bs of a product sheet.

DETAILED DESCRIPTION OF EMBODIMENTS OF THE INVENTION

There will be described an experiment leading to aspects of the invention below.

Experiment 1

Steel slabs of 10 kinds each having a chemical composition comprising C: 0.05 to 0.06 mass %, Si: 3.4 to 3.5 mass %, Mn: 0.06 to 0.08 mass %, S: 0.002 to 0.003 mass %, and Se: 0.005 to 0.006 mass % and a content ratio of sol. Al to N (sol. Al/N) changed within a range of 1.09 to 2.98 as shown in Table 1 are heated to 1400° C., hot rolled to form a hot-rolled sheet having a sheet thickness of 2.4 mm, and subjected to a hot-band annealing at 1000° C. for 60 seconds, the first cold rolling to achieve an intermediate sheet thickness of 1.5 mm, an intermediate annealing at 1100° C. for 60 seconds, and the second (final) cold rolling to obtain cold rolled sheets having various final sheet thicknesses within a range of 0.12 to 0.27 mm.

The steel sheet surface is coated with an annealing separator composed mainly of MgO and dried. Then, the steel sheet is subjected to finishing annealing comprising secondary recrystallization annealing and purification treatment, in which the steel sheet is heated to 900° C. in an $N_2$ atmosphere at a heating rate of 20° C./hr, kept at 900° C. for 10 hours as a keeping treatment, heated from 900° C. to 1150° C. in a mixed atmosphere of 25 vol % $N_2$-75 vol % 1-12 at a heating rate from 950° C. to 1050° C. of 20° C./hr, heated from 1150° C. to 1200° C. in an 1-12 atmosphere at a heating rate of 10° C./hr, subjected to the purification treatment of keeping 1200° C. in an $H_2$ atmosphere for 10 hours, and cooled in a zone of not higher than 800° C. in an $N_2$ atmosphere.

Next, unreacted annealing separator is removed from the steel sheet surface after the finish annealing, and a phosphate-based insulating tension coating is applied thereto.

| Steel | Chemical composition of steel slab (mass %, excluding (—) for sol · Al/N only) | | | | | | | |
|---|---|---|---|---|---|---|---|---|
| No. | C | Si | Mn | S | Se | sol · Al | N | sol · Al/N |
| 1 | 0.055 | 3.46 | 0.07 | 0.002 | 0.005 | 0.010 | 0.0092 | 1.09 |
| 2 | 0.052 | 3.41 | 0.07 | 0.002 | 0.006 | 0.012 | 0.0091 | 1.32 |
| 3 | 0.057 | 3.39 | 0.08 | 0.002 | 0.005 | 0.013 | 0.0091 | 1.43 |
| 4 | 0.049 | 3.44 | 0.07 | 0.002 | 0.005 | 0.015 | 0.0092 | 1.63 |
| 5 | 0.054 | 3.43 | 0.06 | 0.002 | 0.005 | 0.017 | 0.0093 | 1.83 |
| 6 | 0.050 | 3.37 | 0.08 | 0.003 | 0.005 | 0.019 | 0.0093 | 2.04 |
| 7 | 0.052 | 3.40 | 0.07 | 0.002 | 0.005 | 0.021 | 0.0093 | 2.26 |
| 8 | 0.048 | 3.45 | 0.07 | 0.002 | 0.005 | 0.022 | 0.0093 | 2.37 |
| 9 | 0.051 | 3.39 | 0.08 | 0.002 | 0.005 | 0.024 | 0.0090 | 2.67 |
| 10 | 0.051 | 3.38 | 0.07 | 0.002 | 0.005 | 0.028 | 0.0094 | 2.98 |

| | Magnetic flux density $B_8$ (T) best value in coil | | | | | |
|---|---|---|---|---|---|---|
| Steel No. | d = 0.12 mm | d = 0.15 mm | d = 0.18 mm | d = 0.20 mm | d = 0.23 mm | d = 0.27 mm |
| 1 | 1.53 | 1.77 | 1.80 | 1.82 | 1.81 | 1.83 |
| 2 | 1.50 | 1.81 | 1.82 | 1.83 | 1.84 | 1.84 |
| 3 | 1.88 | 1.93 | 1.84 | 1.86 | 1.86 | 1.84 |
| 4 | 1.86 | 1.93 | 1.93 | 1.93 | 1.90 | 1.87 |
| 5 | 1.88 | 1.92 | 1.93 | 1.94 | 1.94 | 1.88 |
| 6 | 1.55 | 1.92 | 1.92 | 1.93 | 1.95 | 1.89 |
| 7 | 1.50 | 1.57 | 1.64 | 1.94 | 1.94 | 1.89 |
| 8 | 1.54 | 1.54 | 1.61 | 1.67 | 1.94 | 1.89 |
| 9 | 1.53 | 1.55 | 1.57 | 1.59 | 1.78 | 1.77 |
| 10 | 1.51 | 1.57 | 1.56 | 1.57 | 1.61 | 1.67 |

| | Magnetic flux density $B_8$(T) guaranteed value in coil | | | | | |
|---|---|---|---|---|---|---|
| Steel No. | d = 0.12 mm | d = 0.15 mm | d = 0.18 mm | d = 0.20 mm | d = 0.23 mm | d = 0.27 mm |
| 1 | 1.85 | 1.84 | 1.86 | 1.89 | 1.90 | 1.86 |
| 2 | 1.86 | 1.90 | 1.90 | 1.91 | 1.91 | 1.86 |
| 3 | 1.88 | 1.94 | 1.91 | 1.93 | 1.91 | 1.88 |
| 4 | 1.89 | 1.94 | 1.94 | 1.95 | 1.93 | 1.90 |
| 5 | 1.90 | 1.93 | 1.94 | 1.95 | 1.95 | 1.91 |
| 6 | 1.89 | 1.93 | 1.94 | 1.95 | 1.96 | 1.91 |
| 7 | 1.88 | 1.93 | 1.94 | 1.95 | 1.96 | 1.92 |
| 8 | 1.61 | 1.90 | 1.92 | 1.94 | 1.96 | 1.93 |
| 9 | 1.58 | 1.74 | 1.66 | 1.66 | 1.95 | 1.93 |
| 10 | 1.59 | 1.61 | 1.61 | 1.63 | 1.69 | 1.92 |

Then, each sheet is subjected to primary recrystallization annealing combined with decarburization annealing in a wet hydrogen atmosphere of 50 vol % $H_2$-50 vol % $N_2$ at 820° C. for 2 minutes. The heating rate from 500° C. to 700° C. in the primary recrystallization annealing is set to 20° C./s.

Then, flattening annealing is conducted for the purpose of baking the coating and flattening the steel strip to obtain a product sheet.

Test specimens for the measurement of magnetic properties are taken out from five positions of 0 m, 1000 m, 2000 m, 3000 m and 4000 m in the longitudinal direction of the thus obtained product sheet having a full length of about 4000 m to measure a magnetic flux density $B_8$ when the magnetization force is 800 A/m. The lowest value of the magnetic flux density in the coil is set to the guaranteed value in the coil, and the highest value thereof is set to the best value in the coil, and the measurement results thereof are also shown in Table 1. Also, the FIGURE shows a range of the sheet thickness d and (sol. Al/N) that provides a magnetic flux density $B_8$ as the guaranteed value in the coil of not less than 1.92 T. Here, the feature that the magnetic flux density $B_8$ as the guaranteed value in the coil is high indicates that secondary recrystallization in the coil is caused uniformly, which is an indication effective for determining the proper development of secondary recrystallization.

As seen from these results, the secondary recrystallization can be stably developed over the full length of the coil to largely improve the magnetic properties of the product sheet, by controlling the content ratio (sol. Al/N) of sol. Al to N in the raw steel material (slab) to a proper range in accordance with the product sheet thickness (final sheet thickness), concretely by controlling the ratio so as to satisfy the following equation (1):

$$4d+0.80 \leq \text{sol. Al/N} \leq 4d+1.50 \quad (1).$$

As to the reason why the proper range of (sol. Al/N) is changed depending on the sheet thickness as mentioned above, the inventors have considered as follows:

The number of primary recrystallized grains in the thickness direction is decreased as the sheet thickness becomes thin, and accordingly the driving force for causing secondary recrystallization is lowered. Therefore, it is necessary to increase the driving force for the secondary recrystallization in some way while keeping the primary recrystallized grains before the secondary recrystallization fine, in response to the decrease in the final sheet thickness d (mm). However, as the value of (sol. Al/N) becomes large, Ostwald growth of AlN is rather advanced, so that the driving force necessary for the secondary recrystallization cannot be ensured, causing poor secondary recrystallization as shown in the FIGURE. On the other hand, as (sol. Al/N) becomes too small, the secondary recrystallization is caused even in grains having a large angle difference from Goss orientation, and hence the magnetic flux density after the secondary recrystallization is decreased or the iron loss is increased.

Experiment 2

A steel slab containing C: 0.06 mass %, Si: 3.1 mass %, Mn: 0.09 mass %, sol. Al: 0.012 mass %, N: 0.0066 mass % (sol. Al/N=1.82), S: 0.013 mass %, Se: 0.005 mass %, Cu: 0.09 mass % and Sb: 0.05 mass % is heated to 1300° C. and hot rolled to obtain a hot-rolled sheet having a sheet thickness of 2.2 mm, which is subjected to a hot-band annealing at 1050° C. for 10 seconds, the first cold rolling to achieve an intermediate sheet thickness of 1.5 mm, an intermediate annealing at 1050° C. for 80 seconds, and further the second cold rolling to obtain a cold-rolled sheet having a final sheet thickness of 0.18 mm.

Then, the sheet is subjected to primary recrystallization annealing combined with decarburization in a wet hydrogen atmosphere of 60 vol % $H_2$-40 vol % $N_2$ at 880° C. for 2 minutes. The heating rate from 500 to 700° C. in the heating process of the primary recrystallization annealing is set to 10° C./s.

Next, the steel sheet surface is coated with an annealing separator composed mainly of MgO and dried. The steel sheet is then subjected to finish annealing comprised of secondary recrystallization annealing and purification treatment, in which the sheet is heated to 860° C. in an $N_2$ atmosphere at a heating rate of 20° C./hr, heated from 860° C. to 1220° C. in an $H_2$ atmosphere, subjected to the purification treatment of keeping the temperature of 1220° C. for 20 hours in an $H_2$ atmosphere, and then cooled in a zone of not higher than 800° C. in an $N_2$ atmosphere.

In the heating from 860° C. to 1220° C., the presence or absence of a keeping treatment of keeping at a temperature of 860° C. for 50 hours and a heating rate from 950 to 1050° C. are changed as heating patterns A to H shown in Table 2. The term "absence" of temperature descending in Table 2 means a case that heating to a high temperature is performed subsequent to the keeping treatment, and the term "presence" of temperature descending shows a case that the temperature is once decreased to not higher than 200° C. after the keeping treatment and then reheating is conducted.

TABLE 2

| | Heating conditions of finish annealing | | | Guaranteed value in coil of product sheet | | | | | |
|---|---|---|---|---|---|---|---|---|---|
| Heating pattern | Presence or absence of keeping treatment at 860° C. for 50 hr | Presence or absence of temperature descending after keeping treatment | Heating rate from 950 to 1050° C. (° C./hr) | Magnetic flux density $B_8$ (T) | Iron loss $W_{17/50}$ (W/kg) | Average value of diameter equivalent to circle (mm) | Average value of aspect ratio (—) | σ of aspect ratio (—) | Area ratio of grains with less than 2 mm (%) |
| A | absence | absence | 20 | 1.55 | 1.91 | 1 | — | — | 64 |
| B | presence | absence | 2 | 1.59 | 1.87 | 2 | — | — | 59 |
| C | presence | absence | 5 | 1.93 | 0.86 | 44 | 1.8 | 0.9 | 3 |
| D | presence | absence | 10 | 1.93 | 0.88 | 31 | 1.6 | 0.8 | 2 |
| E | presence | presence | 10 | 1.93 | 0.87 | 33 | 1.5 | 0.8 | 2 |
| F | presence | absence | 20 | 1.93 | 0.89 | 30 | 1.5 | 0.8 | 2 |
| G | presence | absence | 30 | 1.92 | 0.90 | 18 | 1.6 | 0.9 | 4 |
| H | presence | absence | 50 | 1.88 | 0.98 | 7 | 2.2 | 1.2 | 6 |
| I | presence | absence | 100 | 1.84 | 1.07 | 5 | 2.4 | 1.2 | 9 |

TABLE 2-continued

| | Best value in coil of product sheet | | | | | | |
|---|---|---|---|---|---|---|---|
| Heating pattern | Magnetic flux density $B_8$ (T) | Iron loss $W_{17/50}$ (W/kg) | Average value of diameter equivalent to circle (mm) | Average value of aspect ratio (—) | σ of aspect ratio (—) | Area ratio of grains with less than 2 mm (%) | Remarks |
| A | 1.61 | 1.88 | 1 | — | — | 58 | Comparative Example |
| B | 1.74 | 1.50 | 2 | — | — | 33 | Comparative Example |
| C | 1.94 | 0.82 | 48 | 1.6 | 0.9 | 3 | Invention Example |
| D | 1.94 | 0.83 | 67 | 1.5 | 0.8 | 2 | Invention Example |
| E | 1.94 | 0.83 | 59 | 1.5 | 0.8 | 2 | Invention Example |
| F | 1.94 | 0.85 | 44 | 1.5 | 0.8 | 2 | Invention Example |
| G | 1.93 | 0.87 | 26 | 1.6 | 0.9 | 3 | Invention Example |
| H | 1.92 | 0.92 | 9 | 2.2 | 1.1 | 5 | Comparative Example |
| I | 1.92 | 0.94 | 8 | 2.4 | 1.1 | 6 | Comparative Example |

Unreacted annealing separator is removed from the steel sheet surface after the finish annealing, and a phosphate-based insulating tension coating is applied thereto. Then, flattening annealing is conducted for the purpose of baking the coating and flattening the steel strip to obtain a product sheet.

Samples for the measurement of magnetic properties are taken out from five positions of 0 m, 1000 m, 2000 m, 3000 m and 4000 m in the longitudinal direction of the thus obtained product sheet with a full length of about 4000 m to measure a magnetic flux density $B_8$ when a magnetization force is 800 A/m and an iron loss value $W_{17/50}$ at an amplitude of magnetic flux density of 1.7 T and a frequency of 50 Hz. The measurement results are also shown in Table 2, in which the worst values of $B_8$ and $W_{17/50}$ in the coil are set to the guaranteed values in the coil while the best values of $B_8$ and $W_{17/50}$ in the coil are set to the best values in the coil. Also, a microphotograph of a region of 1000 mm in widthwise central portion and 500 mm in a length in the rolling direction of the sample is subjected to an image processing to measure an average value of the diameter equivalent to a circle, an average value of an aspect ratio represented by (length in the rolling direction)/(length in a direction perpendicular to the rolling direction), and a standard deviation σ thereof in the crystal grains at this region, and a total area ratio of crystal grains having a diameter equivalent to a circle of less than 2 mm. The measured results are also shown in Table 2.

As seen from these results, in the heating pattern A where no keeping treatment is performed at 860° C. for 50 hours on the way of the heating in the finish annealing and in the heating pattern B where the heating rate from 950 to 1050° C. is as low as 2° C./hr, the guaranteed value in the coil is poor because secondary recrystallization is not developed uniformly in the coil, while in the heating patterns C to G where heating is conducted at a heating rate of not less than 5° C./hr after the keeping treatment at 860° C. for 50 hours, secondary recrystallization is stably developed and the magnetic properties are improved over the full length in the coil. As seen from the comparison of the heating patterns D and E, there is no difference in the magnetic properties between the case where the heating is continued to a higher temperature subsequent to the keeping treatment and the case where the temperature is once decreased to not higher than 200° C. after the keeping treatment and then reheating is performed to a higher temperature. However, in the heating patterns H and I where the heating rate after the keeping treatment exceeds 30° C./hr, there is a tendency that the magnetic properties is slightly deteriorated.

Under the condition that the magnetic properties for the guaranteed value in the coil is improved, the crystal grains of the product sheet have an average value of the diameter equivalent to circle of not less than 10 mm, an aspect ratio of less than 2.0, and the standard deviation a of not more than 1.0.

As to the reason why the magnetic properties are improved by properly conducting the keeping treatment in the heating process of the finish annealing as mentioned above even when subsequent heating is performed at a low heating rate, the inventors consider as follows:

The purpose of conducting the keeping treatment at a temperature of 860° C. for 50 hours before the secondary recrystallization occurs in the heating process is to uniform the temperature in the coil. However, Ostwald growth of AlN acting as an inhibitor progresses even in the keeping treatment, resulting in coarsening thereof and lowering of the inhibitor performance. In the prior arts, therefore, it is necessary to apply rapid heating at a high temperature zone (950 to 1050° C.) where the subsequent secondary recrystallization is developed. On the other hand, in accordance with aspects of the invention, the content ratio of sol. Al and N in the steel slab is controlled within a range lower than that of the prior arts, so that Ostwald growth of AlN is suppressed until the keeping treatment is completed in the finish annealing. Therefore, it is possible to shift to the high temperature zone where the secondary recrystallization is developed while keeping the primary recrystallized grains fine, or keeping the driving force for secondary recrystallization high, so that it is not necessary to conduct the rapid heating. Moreover, it is possible to conduct heating at a low rate, so that the temperature difference in the coil is further reduced, and hence the secondary recrystallization can be stably developed over the full length of the coil.

The reason why the crystal grains in the product sheet have an average value of the diameter equivalent to a circle of not less than 10 mm, an average value of the aspect ratio of less than 2.0, and a standard deviation a of not more than 1.0 under the condition that the magnetic properties are improved is considered as follows. That is, under the above condition, the secondary recrystallization can be developed while the driving force for the secondary recrystallization is kept high, and a larger number of coarse secondary recrystallized structures having a small aspect ratio is formed. As a result, the formation of fine crystal grains having a diameter equivalent to a circle of less than 2 mm is also suppressed.

Aspects of the invention are made based on the above novel knowledge.

There will be described the grain-oriented electrical steel sheet according to aspects of the invention below.

Average value of the diameter equivalent to a circle of crystal grains: 10 to 100 mm The grain-oriented electrical steel sheet according to aspects of the invention is necessary to have a diameter equivalent to a circle of the crystal grains in the crystal structure after the secondary recrystallization within the range of 10 to 100 mm on average. When the average value of the diameter equivalent to a circle is less than 10 mm, good magnetic properties cannot be obtained as seen from the above experimental results. On the other hand, when it exceeds 100 mm, the width of the magnetic domains is increased by 180° to deteriorate (increase) the iron loss. In order to obtain better magnetic properties, it is preferably within the range of 30 to 80 mm.

Total area ratio of crystal grains having a diameter equivalent to a circle of less than 2 mm: not more than 1%

In order to obtain better magnetic properties in the grain-oriented electrical steel sheet according to aspects of the invention, the total area ratio of crystal grains having a diameter equivalent to a circle of less than 2 mm in the crystal structure after the secondary recrystallization is preferable to be not more than 1%. It is because the total area ratio exceeding 1% leads to a decrease in the average value of the diameter equivalent to a circle of the crystal grains. It is preferable to be not more than 0.5% to obtain more excellent magnetic properties.

Average value of the aspect ratio of crystal grains: less than 2.0, and standard deviation thereof: not more than 1.0

The grain-oriented electrical steel sheet according to aspects of the invention is necessary to have an average value of the aspect ratio of the crystal grains in the crystal structure after the secondary recrystallization defined by (length in the rolling direction)/(length in a direction perpendicular to the rolling direction) of less than 2.0 and a standard deviation a of not more than 1.0. As seen from the above experimental results, when the average value of the aspect ratio is not less than 2.0 and the standard deviation a exceeds 1.0, good magnetic properties cannot be obtained. In order to obtain better magnetic properties, the average value of the aspect ratio is preferably not more than 1.5, and the standard deviation a thereof is preferably not more than 0.7.

There will be described the chemical composition of the steel slab as a raw material of the grain-oriented electrical steel sheet according to aspects of the invention below.

C: 0.02 to 0.10 mass %

C is an element necessary for an improvement in the structure of the hot-rolled sheet by utilizing γ-α transformation caused in the hot rolling and the hot-band annealing. When the C content is less than 0.02 mass %, the effect of improving the structure of the hot-rolled sheet is small and it is difficult to obtain the desired primary recrystallization texture. On the other hand, when the C content exceeds 0.10 mass %, not only the load of decarburization is increased, but also the decarburization itself becomes incomplete, possibly causing magnetic aging in the product sheet. Therefore, the C content is set to fall within the range of 0.02 to 0.10 mass %. Preferably, it is within the range of 0.03 to 0.08 mass %.

Si: 2.0 to 5.0 mass %

Si is an element extremely effective for increasing an electric resistance of steel to reduce an eddy current loss as a part of the iron loss. When the Si content is less than 2.0 mass %, the electric resistance is so small that a good iron loss property cannot be obtained. When the Si content added to the steel sheet is not more than 11 mass %, the electric resistance is increased monotonously, while when the Si content exceeds 5.0 mass %, the workability is significantly decreased and it is difficult to produce the sheet by rolling. Therefore, the Si content is set to fall within the range of 2.0 to 5.0 mass %. Preferably, it is within the range of 3.0 to 4.0 mass %.

Mn: 0.01 to 0.30 mass %

Mn forms MnS and MnSe precipitates, which act as an inhibitor in the heating process of the finish annealing and suppresses the normal grain growth, and is an important element in the production of the grain-oriented electrical steel sheet. However, when the Mn content is less than 0.01 mass %, the absolute amount of the inhibitor is insufficient to cause the shortage of the force for suppressing the normal grain growth. On the other hand, when the Mn content exceeds 0.30 mass %, it is necessary to heat the slab at a high temperature for complete solid-solution of Mn in the heating process of the slab before the hot rolling. Also, the inhibitor is coarsened by Ostwald growth to cause the shortage of the force of suppressing the normal grain growth. Therefore, the Mn content is set to fall within the range of 0.01 to 0.30 mass %. Preferably, it is within the range of 0.05 to 0.20 mass %.

sol. Al: 0.01 to 0.04 mass %

Al forms AlN precipitates acting as an inhibitor to suppress the normal grain growth in the secondary recrystallization annealing, so that it is an important element in the grain-oriented electrical steel sheet. When the Al content is less than 0.01 mass % as an acid soluble Al (sol. Al), the absolute amount of the inhibitor is insufficient to cause the shortage of the force for suppressing the normal grain growth. On the other hand, when it exceeds 0.04 mass % as sol. Al, AlN is coarsened by Ostwald growth to cause shortage of the force for suppressing the normal grain growth. Therefore, the Al content is set to fall within the range of 0.01 to 0.04 mass %. Preferably, it is within the range of 0.015 to 0.030 mass %.

N: 0.004 to 0.020 mass %

N bonds with Al to form AlN as an inhibitor. When the content is less than 0.004 mass %, the absolute amount of the inhibitor is insufficient to cause the shortage of the force for suppressing the normal grain growth. On the other hand, when the content exceeds 0.020 mass %, slab may be swollen in the hot rolling. Therefore, N content is set to fall within the range of 0.004 to 0.020 mass %. Preferably, it is within the range of 0.006 to 0.010 mass %.

One or two of S and Se: 0.002 to 0.040 mass % in total

S and Se bond to Mn to form MnS and MnSe as an inhibitor.

However, when the elements are less than 0.002 mass % alone or in total, the effect cannot be obtained sufficiently. On the other hand, when the content exceeds 0.040 mass %, the inhibitor is coarsened by Ostwald growth to cause the shortage of the force for suppressing the normal grain growth. Therefore, S and Se contents are set to fall within a range of 0.002 to 0.040 mass % in total. Preferably, it is within the range of 0.005 to 0.030 mass %.

It is important that the steel slab used in accordance with aspects of the invention has, in addition to satisfying the above chemical composition, a content ratio (sol. Al/N) of sol. Al to N (mass %) that satisfies a relation of the following equation (1) with respect to a product sheet thickness d (mm) or a final sheet thickness d (mm) after the cold rolling:

$$4d+0.80 \leq \text{sol. Al/N} \leq 4d+1.50 \quad (1).$$

The reason is as previously mentioned.

In accordance with aspects of the invention, it is important that the value of (sol. Al/N) just before the secondary recrystallization occurs in the finish annealing is within a proper range in accordance with the final sheet thickness d (mm) and the sol. Al content in the steel slab. The N content may be adjusted so as to satisfy the equation (1) by conducting a nitriding treatment in any of the steps before the secondary recrystallization occurs in the finish annealing.

The steel slab used in accordance with aspects of the invention contains Fe and inevitable impurity as the residue other than the above ingredients. For the purpose of further improving the magnetic properties, Ni, Sb, Sn, Cu, Cr, P, Mo, Ti, Nb, V, B, Bi, Te and Ta may be contained within the range of Ni: 0.01 to 1.00 mass %, Sb: 0.005 to 0.50 mass %, Sn: 0.005 to 0.50 mass %, Cu: 0.01 to 0.50 mass %, Cr: 0.01 to 0.50 mass %, P: 0.005 to 0.50 mass %, Mo: 0.005 to 0.10 mass %, Ti: 0.001 to 0.010 mass %, Nb: 0.001 to 0.010 mass %, V: 0.001 to 0.010 mass %, B: 0.0002 to 0.0025 mass %, Bi: 0.005 to 0.50 mass %, Te: 0.0005 to 0.010 mass % and Ta: 0.001 to 0.010 mass % in addition to the above ingredients. All of Ni, Sb, Sn, Cu, Cr, P, Mo, Ti, Nb, V, B, Bi, Te and Ta, are elements useful for improving the magnetic properties. However, when each content is less than the lower limit of the above range, the effect of improving the magnetic properties is poor, while when each content exceeds the upper limit of the above range, the secondary recrystallization becomes unstable to bring about the deterioration of the magnetic properties.

There will be described the production method of the grain-oriented electrical steel sheet according to aspects of the invention using the above steel slab below.

In the production method of the grain-oriented electrical steel sheet according to aspects of the invention, a steel slab having the aforementioned chemical composition is first heated to a high temperature of not lower than 1250° C. and then subjected to hot rolling. When the heating temperature of the slab is lower than 1250° C., the solid-solution of the added inhibitor forming elements in steel is not sufficient. A preferable heating temperature of the slab is within the range of 1300 to 1450° C. The means for heating the slab may be any well-known means such as gas furnace, induction heating furnace, current-carrying furnace and so on. Also, the hot rolling subsequent to the heating of the slab may be conducted under conventionally known conditions and is not particularly limited.

The steel sheet (hot-rolled sheet) after the hot rolling may be subjected to hot-band annealing for the purpose of improving the structure of the hot-rolled sheet. The hot-band annealing is preferably conducted under a condition of soaking temperature: 800 to 1200° C. and soaking time: 2 to 300 seconds. When the soaking temperature is lower than 800° C. and/or the soaking time is less than 2 seconds, the effect of improving the structure of the hot-rolled sheet cannot be obtained sufficiently and the desired structure after the hot-band annealing may not be obtained because a non-recrystallized portion remains. On the other hand, when the soaking temperature exceeds 1200° C. and/or the soaking time exceeds 300 seconds, Ostwald growth of AlN, MnSe and MnS progresses, and the suppressing force of the inhibitor necessary for secondary recrystallization is insufficient, causing the deterioration of the magnetic properties.

Next, the hot-rolled sheet after the hot rolling or after the hot-band annealing is subjected to one cold rolling or two or more cold rollings including an intermediate annealing therebetween to obtain a cold-rolled sheet having a final sheet thickness. The intermediate annealing may be conducted under a conventionally know condition, and is preferably conducted at a soaking temperature of 800 to 1200° C. for soaking time of 2 to 300 seconds. When the soaking temperature is lower than 800° C. and/or the soaking time is less than 2 seconds, a non-recrystallized structure remains to make it difficult to obtain a structure of regulated grains through primary recrystallization. Accordingly, the desired secondary recrystallized grains may not be obtained to cause the deterioration of the magnetic properties. On the other hand, when the soaking temperature exceeds 1200° C. and/or the soaking time exceeds 300 seconds, Ostwald growth of AlN, MnSe and MnS is advanced to cause the shortage of the suppressing force of the inhibitor necessary for the secondary recrystallization. Thus, the secondary recrystallization is hindered to bring about the deterioration of the magnetic properties.

Also, the cooling after the soaking in the intermediate annealing is preferably conducted from 800 to 400° C. at a cooling rate of 10 to 200° C./s. When the cooling rate is less than 10° C./s, the coarsening of carbide is advanced, and hence the effect of improving the texture in the subsequent cold rolling and the primary recrystallization annealing is lowered, so that the magnetic properties tend to be deteriorated. On the other hand, when the cooling rate from 800 to 400° C. exceeds 200° C./s, a hard martensite phase is formed, and the desired structure cannot be obtained after the primary recrystallization, which may cause deterioration of the magnetic properties.

The grain-oriented electrical steel sheet according to aspects of the invention has a product sheet thickness (final sheet thickness in the cold rolling) within the range of 0.15 to 0.23 mm. When aspects of the invention are applied to a steel sheet having a sheet thickness of more than 0.23 mm, the driving force for secondary recrystallization becomes excessive and the dispersion of secondary recrystallized grains from Goss orientation may increase. On the other hand, when the thickness is less than 0.15 mm, it is difficult to stably develop secondary recrystallization even if aspects of the invention is applied, and also a ratio of the insulation coating becomes relatively large to decrease the magnetic flux density and it becomes difficult to produce the sheet by rolling.

In the production method according to aspects of the invention, inter-pass aging or warm rolling may be applied in the cold rolling achieving the final sheet thickness (final cold rolling).

It is preferable that the cold-rolled sheet, which has been cold-rolled to have the final sheet thickness, is subjected to primary recrystallization annealing combined with decarburization annealing in a wet hydrogen atmosphere controlled to have a value of $P_{H2O}/P_{H2}>0.1$ at a temperature of 700 to 1000° C. When the decarburization annealing temperature is lower than 700° C., the decarburization reaction may not be proceeded sufficiently and decarburization may not reach not more than 0.005 mass % of C, which causes no magnetic aging, and moreover, desired primary recrystallized structure cannot be obtained due to remaining non-recrystallized portions. On the other hand, the soaking temperature exceeding 1000° C. may cause secondary recrystallization. More preferably, the decarburization temperature falls within the range of 800 to 900° C. Moreover, the C content after the decarburization annealing is preferably not more than 0.003 mass %.

A primary recrystallized texture suitable for the grain-oriented electrical steel sheet having excellent magnetic properties is obtained by conducting the primary recrystallization annealing combined with the decarburization annealing while satisfying the above conditions. In the heating process of the primary recrystallization annealing, the heating rate from 500 to 700° C. for causing the recovery of the structure after the cold rolling is preferably not less than 50° C./s. Rapid heating within the above temperature zone suppresses the recovery of Goss orientation grains and preferentially causes the recrystallization in the high temperature zone. Thus, the ratio of Goss orientation grains in the primary recrystallized structure is increased to stably develop the secondary recrystallization, and moreover, the magnetic flux density is increased while the crystal grains after the secondary recrystallization is sub-divided, whereby the iron loss property can be improved. More preferably, it is not less than 80° C./s.

In the primary recrystallization annealing combined with decarburization annealing, an atmosphere in the rapid heating is preferably an oxidation atmosphere, which is suitable for decarburization (for example, $P_{H2O}/P_{H2}>0.1$). When it is difficult to create the oxidation atmosphere due to restriction of equipment or the like, it may be an atmosphere of $P_{H2O}/P_{H2}\leq 0.1$, because the decarburization reaction is mainly advanced in the vicinity of 800° C., which is higher than the rapid heating temperature zone. When the decarburization is important, the primary recrystallization annealing accompanying with the rapid heating and the decarburization annealing may be conducted separately.

Thereafter, the cold-rolled sheet subjected to the primary recrystallization annealing combined with the decarburization annealing is coated on its surface with an annealing separator composed mainly of MgO for example, dried and subjected to the most important step in accordance with aspects of the invention, or finish annealing. Finish annealing in a production method of a grain-oriented electrical steel sheet using an inhibitor in secondary recrystallization is usually comprised of a secondary recrystallization annealing for causing the secondary recrystallization and a purification treatment for removing the inhibitor-forming ingredient and the like. In the purification treatment, the steel sheet is usually heated up to about 1200° C. Also, the purification treatment may be conducted combined with the formation of forsterite coating onto the steel sheet surface.

In the finish annealing according to aspects of the invention, it is necessary that the steel sheet is subjected to a keeping treatment for keeping the sheet at a temperature zone of higher than 850° C. but not higher than 950° C. before the start of the secondary recrystallization in the heating process for 5 to 200 hours, subsequently heated from 950 to 1050° C. at a heating rate of 5 to 30° C./hr to complete the secondary recrystallization or, after the keeping treatment, cooled to not higher than 700° C. once and reheated and heated from 950 to 1050° C. at a heating rate of 5 to 30° C./hr to complete the secondary recrystallization, and then the steel sheet is further heated and subjected to a purification treatment by keeping the sheet at not lower than 1100° C. for not less than 2 hours.

Each process of the finish annealing according to aspects of the invention will be described concretely below.

First, the reason for conducting the keeping treatment at a temperature zone of higher than 850° C. but not higher than 950° C. for 5 to 200 hours is to make the temperature in the coil uniform and develop the secondary recrystallization uniformly in the subsequent heating to a higher temperature zone by keeping the sheet at a temperature for a long time just below the temperature at which the occurrence of the secondary recrystallization. When the temperature in the keeping treatment is not higher than 850° C., the difference between the temperature in the high temperature zone where the secondary recrystallization occurs and the temperature in the keeping treatment is large, resulting in non-uniform temperature in the coil during the heating to the high temperature zone. On the other hand, when it exceeds 950° C., the secondary recrystallization may be locally developed in the coil. Moreover, when the keeping treatment time is less than 5 hours, the effect of uniformizing the temperature in the coil cannot be obtained sufficiently and the secondary recrystallization is developed non-uniformly. On the other hand, when it exceeds 200 hours, the above effect is saturated and the decrease in productivity is caused. Preferably, it falls within the range of 10 to 100 hours. Here, the keeping treatment time is defined as the time when the steel sheet temperature at the coldest point in the coil retains at a temperature of higher than 850° C. but not higher than 950° C.

The keeping treatment may be a soaking treatment for holding a specified temperature of higher than 850° C. but not higher than 950° C. or a slow heating of gradually heating from a temperature of higher than 850° C. to a temperature of not higher than 950° C. spending 5 to 200 hours. Also, the soaking treatment and the slow heating may be conducted in combination In the heating to a high temperature zone for causing the secondary recrystallization subsequent to the keeping treatment, the heating rate from 950 to 1050° C. is necessary to be within the range of 5 to 30° C./hr. When the heating rate is less than 5° C./hr, the normal grain growth of the primary recrystallized grains is caused remarkably, and hence the driving force for the secondary recrystallization is decreased to make it difficult to develop the secondary recrystallization. On the other hand, when the heating rate exceeds 30° C./hr, the sharpness of the secondary recrystallized grains in Goss orientation is lowered and the magnetic properties tends to be deteriorated as seen from Table 2, which is previously shown.

Moreover, the heating to the high temperature zone for the secondary recrystallization after the keeping treatment before the secondary recrystallization may be continued subsequent to the keeping treatment, or conducted after decreasing the temperature to not higher than 700° C. once subsequent to the keeping treatment and thereafter reheating.

Then, the steel sheet after the completion of the secondary recrystallization at the high temperature zone is subjected to a purification treatment for removing the inhibitor-forming ingredient or impurity elements added to the raw steel material (slab) or further forming a forsterite coating. The purification treatment is necessary to be conducted by keeping a temperature of not lower than 1100° C. in a hydrogen atmosphere for not less than 2 hours, and concretely, by keeping a temperature of 1150 to 1250° C. for 2 to 20 hours. The inhibitor forming ingredients contained in the steel sheet, or Al, N, S and Se can be reduced to an inevitable impurity level by the purification treatment.

Moreover, the keeping treatment may be conducted subsequent to the annealing for completing the secondary recrystallization, or may be conducted by descending the temperature to not higher than 700° C. once after the secondary recrystallization annealing and then reheating.

The atmosphere gas in the finish annealing may use a single gas selected from $N_2$, $H_2$, and Ar or a mixed gas thereof. In general, $N_2$ gas is used in the heating process and the cooling process at a temperature of not higher than 850° C., and a single gas of $H_2$ or Ar or a mixed gas of $H_2$ and $N_2$ or a mixed gas of $H_2$ and Ar is used at the higher temperature zone. Moreover, the purification is further advanced by using $H_2$ gas as an atmosphere of the purification treatment.

The steel sheet subjected to the finish annealing is then subjected to an insulation coating application step and a flattening annealing step after the unreacted annealing separator is removed from the steel sheet surface to obtain the desired grain-oriented electrical steel sheet (product sheet).

In the grain-oriented electrical steel sheet (product sheet) produced with satisfying the above conditions, C is reduced to not more than 0.0050 mass % at the primary recrystallization annealing step combined with the decarburization annealing, and S, Se, Al and N as an inhibitor-forming ingredient other than Mn are reduced to an inevitable impurity level (not more than 0.0030 mass %) by the finish annealing step. The composition of Si and Mn as an essential ingredient other than the above ingredients, and Ni, Sb, Sn, Cu, Cr, P, Mo, Ti, Nb, V, B, Bi, Te and Ta as an arbitrary addition ingredient does not change in the production process and the chemical composition of the steel slab as a raw material is maintained as it is. Moreover, the preferable C content in the product sheet is not more than 0.0030 mass %, and each content of S, Se, Al and N is not more than 0.0020 mass %.

The grain-oriented electrical steel sheet produced with satisfying the above conditions also has an extremely high magnetic flux density and a low iron loss after the secondary recrystallization. Here, the high magnetic flux density means that only the orientation in the vicinity of Goss orientation as an ideal orientation is preferentially grown in the secondary recrystallization. It is also known that the growing rate of the secondary recrystallized grains is increased as the orientation of the secondary recrystallized grains is in the vicinity of Goss orientation. Therefore, the high magnetic flux density also indicates that the secondary recrystallized grains are coarsened. However, the coarsening of the secondary recrystallized grains is advantageous from a viewpoint of reducing the hysteresis loss, but is disadvantageous from a viewpoint of reducing the eddy current loss.

From a viewpoint of reducing the iron loss, which is the sum of the hysteresis loss and the eddy current loss, it is preferable to conduct magnetic domain subdividing treatment in any of the steps after the final cold rolling for obtaining a product sheet thickness. The subdividing of magnetic domains can reduce the eddy current loss, which has been increased through the coarsening of the secondary recrystallized grains, and also an extremely low iron loss can be obtained together with the increase in an integration degree to Goss orientation and the reduction of the hysteresis loss by high purification. As the method of subdividing the magnetic domains may use a well-known heat-resistant type or non-heat-resistant type magnetic domain subdividing treatment. The magnetic domain subdivision effect can penetrate into the inside of the steel sheet in the thickness direction by irradiating an electron beam or a laser beam on the steel sheet surface after secondary recrystallization, so that an excellent iron loss property can be obtained as compared to other magnetic domain subdividing treatments such as etching process or the like.

EXAMPLES

Example 1

A steel slab having a different chemical composition shown in Table 3 is heated to 1380° C. and hot rolled to form a hot-rolled sheet having a sheet thickness of 2.7 mm. The hot-rolled sheet is subjected to a hot-band annealing at 1050° C. for 30 seconds, the first cold rolling to reach an intermediate sheet thickness of 1.8 mm, an intermediate annealing at 1080° C. for 60 seconds, and a second cold rolling (final cold rolling) to obtain a cold-rolled sheet having a final sheet thickness of 0.23 mm. Then, the cold-rolled sheet is subjected to primary recrystallization annealing combined with decarburization annealing in a wet hydrogen atmosphere of 50 vol % $H_2$-50 vol % $N_2$ ($P_{H2O}/P_{H2}$:0.41) at 860° C. for 2 minutes. In this case, the cooling rate from 800 to 400° C. in the intermediate annealing is set to 30° C./s, and a heating rate from 500 to 700° C. in the primary recrystallization annealing is set to 30° C./s.

Then, the steel sheet is coated on its surface with an annealing separator composed mainly of MgO, dried and subjected to a finishing annealing combined with a secondary recrystallization annealing and a purification treatment in which the steel sheet is heated up to 930° C. in an $N_2$ atmosphere at a heating rate of 20° C./hr, kept at 930° C. for 50 hours as a keeping treatment, heated from 930° C. to 1150° C. in a mixed atmosphere of 25 vol % $N_2$-75 vol % $H_2$ at a heating rate from 950 to 1050° C. of 20° C./hr, heated from 1150° C. to 1240° C. in a $H_2$ atmosphere at a heating rate of 5° C./hr, further subjected to the purification treatment in a $H_2$ atmosphere at 1240° C. for 10 hours, and then cooled to not higher than 800° C. in an $N_2$ atmosphere. Unreacted annealing separator is removed from the steel sheet surface after the finish annealing, and the steel sheet is coated with a phosphate-based insulating tensile coating and subjected to a flattening annealing for the purpose of baking the coating and flattening the steel strip to obtain a product sheet.

Test specimens for the measurement of magnetic properties are taken out from 5 positions of 0 m, 1000 m, 2000 m, 3000 m and 4000 m in the longitudinal direction of the thus obtained product sheet having a full length of about 4000 m to measure an iron loss value $W_{17/50}$ at a magnetic flux density of 1.7 T, in which the worst value of the iron loss in the five positions is defined as a guaranteed value in the coil and the best value of the iron loss is defined as the best value in the coil. The measurement results are shown in Table 4. Also, a microphotograph of a region of 1000 mm in widthwise central portion and 500 mm in the rolling direction of the product coil is subjected to an image processing to measure an average value of the dimeter equivalent to a circle, an average value of an aspect ratio represented by (length in the rolling direction)/(length in a direction perpendicular to the rolling direction), and a standard deviation thereof in the crystal grains in the region and a total area ratio of crystal grains having the diameter equivalent to a circle of less than 2 mm. The measurement results are also shown in Table 4. As seen from Table 4, the product sheet having a chemical composition adapted according to aspects of the invention is excellent in the iron loss property over the full length of the coil.

TABLE 3

| Steel sheet | Chemical composition of steel slab (mass %, but (—) only for sol. Al/N) | | | | | | | | | |
|---|---|---|---|---|---|---|---|---|---|---|
| No. | C | Si | Mn | sol. Al | N | S | Se | Other elements | sol. Al/N | Remarks |
| 1 | 0.051 | 1.83 | 0.14 | 0.026 | 0.012 | 0.021 | — | — | 2.17 | Comparative Example |
| 2 | 0.072 | 3.57 | 0.09 | 0.016 | 0.007 | 0.019 | — | — | 2.29 | Invention Example |
| 3 | 0.047 | 5.62 | 0.12 | 0.020 | 0.009 | 0.013 | — | — | 2.22 | Comparative Example |
| 4 | 0.011 | 3.26 | 0.11 | 0.021 | 0.009 | 0.025 | — | — | 2.33 | Comparative Example |
| 5 | 0.055 | 3.39 | 0.13 | 0.024 | 0.010 | 0.008 | 0.021 | — | 2.40 | Invention Example |
| 6 | 0.109 | 3.20 | 0.12 | 0.022 | 0.010 | 0.021 | — | — | 2.20 | Comparative Example |
| 7 | 0.051 | 3.38 | 0.009 | 0.022 | 0.010 | 0.024 | — | — | 2.20 | Comparative Example |
| 8 | 0.059 | 3.22 | 0.11 | 0.023 | 0.010 | 0.003 | 0.006 | — | 2.30 | Invention Example |
| 9 | 0.063 | 3.16 | 0.36 | 0.018 | 0.008 | 0.027 | — | — | 2.25 | Comparative Example |
| 10 | 0.060 | 3.15 | 0.12 | 0.005 | 0.010 | 0.021 | — | — | 0.50 | Comparative Example |
| 11 | 0.069 | 3.5 | 0.11 | 0.018 | 0.009 | 0.006 | — | — | 2.00 | Invention Example |
| 12 | 0.071 | 3.22 | 0.13 | 0.042 | 0.009 | 0.028 | — | — | 4.67 | Comparative Example |
| 13 | 0.063 | 3.34 | 0.09 | 0.021 | 0.003 | 0.026 | — | — | 7.00 | Comparative Example |
| 14 | 0.059 | 3.27 | 0.10 | 0.015 | 0.008 | 0.019 | 0.011 | — | 1.88 | Invention Example |
| 15 | 0.023 | 3.21 | 0.12 | 0.023 | 0.022 | 0.027 | — | — | 1.05 | Comparative Example |
| 16 | 0.061 | 3.24 | 0.13 | 0.025 | 0.011 | — | — | — | 2.27 | Comparative Example |
| 17 | 0.077 | 3.46 | 0.08 | 0.019 | 0.009 | 0.022 | 0 | — | 2.11 | Invention Example |
| 18 | 0.054 | 3.29 | 0.14 | 0.026 | 0.012 | 0.045 | 0 | — | 2.17 | Comparative Example |
| 19 | 0.047 | 3.22 | 0.09 | 0.023 | 0.010 | — | 0.041 | — | 2.30 | Comparative Example |
| 20 | 0.049 | 3.33 | 0.12 | 0.021 | 0.009 | 0.029 | 0.015 | — | 2.33 | Comparative Example |
| 21 | 0.023 | 2.26 | 0.14 | 0.026 | 0.013 | 0.003 | — | Sb: 0.05, Cu: 0.01, P: 0.02, Mo: 0.09, Ti: 0.003, Nb: 0.0016 | 2.00 | Invention Example |
| 22 | 0.044 | 2.93 | 0.09 | 0.023 | 0.011 | 0.006 | — | Sn: 0.01, Cr: 0.43, P: 0.007, Ti: 0.009, V: 0.002, B: 0.0004, Bi: 0.006 | 2.09 | Invention Example |
| 23 | 0.056 | 3.40 | 0.08 | 0.020 | 0.009 | 0.015 | 0.005 | Sb: 0.03, Cu: 0.11, P: 0.02, Ti: 0.002 | 2.22 | Invention Example |
| 24 | 0.059 | 3.32 | 0.11 | 0.029 | 0.013 | 0.023 | 0.011 | Sn: 0.43, Ni: 0.88, Cr: 0.07, P: 0.07, Ti: 0.003, Te: 0.0008, Ta: 0.009 | 2.23 | Invention Example |
| 25 | 0.051 | 3.43 | 0.21 | 0.011 | 0.005 | — | 0.024 | Sb: 0.07, Cu: 0.23, P: 0.02, Mo: 0.03, Ti: 0.002 | 2.20 | Invention Example |
| 26 | 0.066 | 3.49 | 0.08 | 0.016 | 0.008 | 0.021 | — | Ni: 0.03, Sn: 0.12, Cu: 0.08, Cr: 0.05, P: 0.02, Mo: 0.01, Ti: 0.003 | 2.00 | Invention Example |
| 27 | 0.055 | 3.34 | 0.13 | 0.014 | 0.007 | 0.036 | 0.002 | Sb: 0.007, Sn: 0.16 , P: 0.11, Mo: 0.02, Ti: 0.001, V: 0.009 | 2.00 | Invention Example |
| 28 | 0.093 | 4.81 | 0.07 | 0.023 | 0.010 | 0.021 | 0.014 | Ni: 0.23, Sn: 0.06, Cr: 0.14, P: 0.46, Ti: 0.002, Bi: 0.42, Ta: 0.009 | 2.30 | Invention Example |
| 29 | 0.081 | 3.44 | 0.08 | 0.015 | 0.008 | 0.002 | 0.006 | Sb: 0.05, Cu: 0.12, Cr: 0.05, P: 0.07, Mo: 0.01, Ti: 0.002 | 1.88 | Invention Example |
| 30 | 0.061 | 3.39 | 0.10 | 0.037 | 0.019 | — | 0.037 | Sn: 0.05, Cu: 0.47, P: 0.03, Ti: 0.006, Nb: 0.009, Te: 0.008 | 1.95 | Invention Example |
| 31 | 0.062 | 4.01 | 0.09 | 0.017 | 0.008 | 0.014 | 0.005 | Sb: 0.03, Cr: 0.01, P: 0.05, Mo: 0.01, Ti: 0.002, B: 0.0022 | 2.13 | Invention Example |
| 32 | 0.052 | 3.42 | 0.10 | 0.014 | 0.008 | 0.017 | 0.012 | Ni: 0.02, Sn: 0.08, P: 0.02, Mo: 0.007, Ti: 0.002 | 1.75 | Invention Example |

TABLE 4

| Steel sheet No. | Guaranteed value in coil of product sheet: Iron loss $W_{17/50}$ (W/kg) | Average value of diameter equivalent to a circle (mm) | Average value of aspect ratio (—) | σ of aspect ratio (—) | Area ratio of grains of less than 2 mm (%) | Best value in coil of product sheet: Iron loss $W_{17/50}$ (W/kg) | Average value of diameter equivalent to a circle (mm) | Average value of aspect ratio (—) | σ of aspect ratio (—) | Area ratio of grains of less than 2 mm (%) | Remarks |
|---|---|---|---|---|---|---|---|---|---|---|---|
| 1 | 2.44 | 1 | — | — | 94 | 2.39 | 1 | — | — | 91 | Comparative Example |
| 2 | 0.96 | 13 | 1.6 | 1.0 | 0.7 | 0.95 | 16 | 1.5 | 0.9 | 0 | Invention Example |
| 3 | 1.98 | 1 | — | — | 88 | 1.90 | 1 | — | — | 84 | Comparative Example |
| 4 | 2.04 | 1 | — | — | 91 | 1.98 | 1 | — | — | 88 | Comparative Example |
| 5 | 0.94 | 34 | 1.5 | 1.0 | 0 | 0.91 | 37 | 1.5 | 0.8 | 0 | Invention Example |
| 6 | 2.11 | 1 | — | — | 90 | 2.02 | 1 | — | — | 91 | Comparative Example |
| 7 | 2.14 | 1 | — | — | 84 | 2.11 | 1 | — | — | 85 | Comparative Example |
| 8 | 0.99 | 24 | 1.7 | 0.9 | 0.3 | 0.93 | 25 | 1.6 | 0.8 | 0 | Invention Example |
| 9 | 2.13 | 1 | — | — | 88 | 2.05 | 1 | — | — | 81 | Comparative Example |
| 10 | 2.09 | 1 | — | — | 90 | 1.41 | 3 | — | — | 29 | Comparative Example |
| 11 | 0.97 | 28 | 1.6 | 0.9 | 0 | 0.95 | 31 | 1.6 | 0.9 | 0 | Invention Example |
| 12 | 2.06 | 1 | — | — | 91 | 2.00 | 1 | — | — | 80 | Comparative Example |
| 13 | 2.14 | 1 | — | — | 93 | 1.24 | 4 | — | — | 16 | Comparative Example |
| 14 | 0.98 | 33 | 1.6 | 0.9 | 0 | 0.94 | 33 | 1.5 | 0.8 | 0 | Invention Example |
| 15 | 2.08 | 1 | — | — | 88 | 2.03 | 1 | — | — | 92 | Comparative Example |
| 16 | 2.19 | 1 | — | — | 92 | 0.94 | 26 | — | — | 0 | Comparative Example |
| 17 | 1.00 | 36 | 1.7 | 1.0 | 0 | 0.95 | 39 | 1.6 | 0.9 | 0 | Invention Example |
| 18 | 2.10 | 1 | — | — | 91 | 1.97 | 1 | — | — | 84 | Comparative Example |
| 19 | 2.14 | 1 | — | — | 90 | 1.99 | 1 | — | — | 82 | Comparative Example |
| 20 | 2.00 | 1 | — | — | 92 | 1.96 | 1 | — | — | 85 | Comparative Example |
| 21 | 1.02 | 46 | 1.3 | 0.8 | 0 | 0.98 | 51 | 1.3 | 0.8 | 0 | Invention Example |
| 22 | 0.96 | 54 | 1.4 | 0.8 | 0 | 0.91 | 50 | 1.3 | 0.7 | 0 | Invention Example |
| 23 | 0.89 | 43 | 1.2 | 0.7 | 0 | 0.84 | 54 | 1.2 | 0.7 | 0 | Invention Example |
| 24 | 0.91 | 49 | 1.4 | 0.8 | 0 | 0.86 | 51 | 1.4 | 0.8 | 0 | Invention Example |
| 25 | 0.88 | 41 | 1.3 | 0.8 | 0 | 0.84 | 44 | 1.3 | 0.7 | 0 | Invention Example |
| 26 | 0.89 | 41 | 0.9 | 0.6 | 0.5 | 0.80 | 46 | 0.9 | 0.7 | 0 | Invention Example |
| 27 | 0.90 | 43 | 1.2 | 0.7 | 0 | 0.85 | 42 | 1.2 | 0.6 | 0 | Invention Example |
| 28 | 0.73 | 48 | 1.3 | 0.6 | 0 | 0.70 | 50 | 1.3 | 0.6 | 0 | Invention Example |
| 29 | 0.88 | 52 | 1.2 | 0.6 | 0 | 0.85 | 55 | 1.3 | 0.7 | 0 | Invention Example |
| 30 | 0.89 | 61 | 1.2 | 0.8 | 0 | 0.86 | 67 | 1.2 | 0.7 | 0 | Invention Example |
| 31 | 0.82 | 91 | 1.3 | 0.7 | 0 | 0.80 | 93 | 1.2 | 0.6 | 0 | Invention Example |
| 32 | 0.90 | 72 | 1.2 | 0.6 | 0 | 0.85 | 71 | 1.2 | 0.6 | 0 | Invention Example |

Example 2

A steel slab having a chemical composition of No. 23 used in Example 1 (Invention Example) is heated to 1420° C. and hot rolled to form a hot-rolled coil having a sheet thickness of 2.0 mm, which is subjected to a hot-band annealing at 1100° C. for 60 seconds and cold rolled to obtain a cold-rolled sheet having a final sheet thickness of 0.18 mm. Then, the sheet is subjected to a primary recrystallization annealing combined with decarburization in a wet hydrogen atmosphere of 50 vol % $H_2$-50 vol % $N_2$ ($P_{H2O}/P_{H2}$:0.44) at 830° C. for 2 minutes. In this case, the cooling rate from 800 to 400° C. in the hot-band annealing is 60° C./s and the heating rate from 500 to 700° C. in the primary recrystallization annealing are variously changed as shown in Table 4.

Then, the steel sheet is coated on its surface with an annealing separator composed mainly of MgO, dried, subjected to finish annealing combined with secondary recrystallization annealing and purification treatment in which the steel sheet is heated to 900° C. in an $N_2$ atmosphere at a heating rate of 20° C./hr, kept at 900° C. for 200 hours as a keeping treatment, heated from 900° C. to 1150° C. in a mixed atmosphere of 25 vol % $N_2$-75 vol % $H_2$ at a heating rate from 950 to 1050° C. of 10° C./hr, heated from 1150° C. to 1200° C. in a $H_2$ atmosphere at 15° C./hr, subjected to a purification treatment at 1200° C. in a $H_2$ atmosphere for 20 hours, and then cooled to not higher than 800° C. in an $N_2$ atmosphere. Unreacted annealing separator is removed from the steel sheet surface after the finish annealing, and then the steel sheet is coated with a phosphate-based insulating tensile coating and subjected to a flattening annealing for the purpose of baking the coating and flattening the steel strip to obtain a product sheet.

Further, some product sheets are subjected to three kinds of a magnetic domain subdividing treatment shown in Table 5. An etching groove having a width of 60 μm and a depth of 20 μm is formed onto one side surface of the steel sheet, which is cold rolled to have a thickness of 0.18 mm, in a direction perpendicular to the rolling direction at an interval of 5 mm in the rolling direction. Also, an electron beam is continuously irradiated to one side surface of the product sheet in the direction perpendicular to the rolling direction under conditions that an acceleration voltage is 100 kV, a beam current is 3 mA, and an interval in the rolling direction is 5 mm. Further, a laser beam is continuously irradiated to one side surface of the product sheet in the direction perpendicular to the rolling direction under conditions that a beam diameter is 0.3 mm, an output power is 200 W, a scanning rate is 100 m/s, and an interval in the rolling direction is 5 mm.

Test specimens for the measurement of magnetic properties are taken out from 5 positions of 0 m, 1000 m, 2000 m, 3000 m and 4000 m in the longitudinal direction of the thus obtained product sheet having a full length of about 4000 m to measure an iron loss value $W_{17/50}$ at a magnetic flux density of 1.7 T. The worst value of the iron loss is defined as a guaranteed value in the coil and the best value of the iron loss is the best value in the coil among the five positions. The measurement results are also shown in Table 5. Also, a microphotograph of a region of 1000 mm in widthwise central portion and 500 mm in the rolling direction of the product coil is subjected to an image processing to measure an average value of the diameter equivalent to a circle, an average value of an aspect ratio represented by (length in the rolling direction)/(length in a direction perpendicular to the rolling direction) and a standard deviation thereof in the crystal grains at this region, and a total area ratio of crystal grains having a diameter equivalent to a circle of less than 2 mm. The measured results are also shown in Table 5.

As seen from Table 5, the iron loss property is improved as the heating rate from 500 to 700° C. in the primary recrystallization annealing is increased, while the iron loss property is improved by performing the magnetic domain subdividing treatment to all heating rates and the improvement effect of the electron beam irradiation and laser beam irradiation is large.

TABLE 5

| | Production conditions | | Guaranteed value in coil of product sheet | | | | |
|---|---|---|---|---|---|---|---|
| Steel sheet No. | Heating rate in primary recrystallization annealing (° C./s) | Magnetic domain subdividing treatment | Iron loss $W_{17/50}$ (W/kg) | Average value of diameter equivalent to circle (mm) | Average value of aspect ratio (—) | σ of aspect ratio (—) | Area ratio of grains with less than 2 mm (%) |
| 23-a-0 | 20 | None | 0.83 | 41 | 1.3 | 0.7 | 0 |
| 23-a-1 | 20 | Etching grooves | 0.62 | 44 | 1.2 | 0.8 | 0 |
| 23-a-2 | 20 | Electron beam | 0.59 | 43 | 1.3 | 0.7 | 0 |
| 23-a-3 | 20 | Continuous lazar | 0.59 | 43 | 1.3 | 0.7 | 0 |
| 23-b-0 | 50 | None | 0.78 | 39 | 1.1 | 0.6 | 0 |
| 23-b-1 | 50 | Etching grooves | 0.61 | 38 | 1.2 | 0.7 | 0 |
| 23-b-2 | 50 | Electron beam | 0.58 | 38 | 1.1 | 0.6 | 0 |
| 23-b-3 | 50 | Continuous lazar | 0.58 | 38 | 1.1 | 0.6 | 0 |
| 23-c-0 | 200 | None | 0.77 | 32 | 1.0 | 0.6 | 0 |
| 23-c-1 | 200 | Etching grooves | 0.60 | 33 | 1.1 | 0.5 | 0 |
| 23-c-2 | 200 | Electron beam | 0.57 | 34 | 1.1 | 0.6 | 0 |
| 23-c-3 | 200 | Continuous lazar | 0.57 | 33 | 1.0 | 0.5 | 0 |

TABLE 5-continued

| Steel sheet No. | Best value in coil of product sheet: Iron loss $W_{17/50}$ (W/kg) | Average value of diameter equivalent to circle (mm) | Average value of aspect ratio (—) | σ of aspect ratio (—) | Area ratio of grains with less than 2 mm (%) | Remarks |
|---|---|---|---|---|---|---|
| 23-a-0 | 0.8 | 46 | 1.2 | 0.7 | 0 | Invention Example |
| 23-a-1 | 0.58 | 45 | 1.2 | 0.7 | 0 | Invention Example |
| 23-a-2 | 0.56 | 45 | 1.3 | 0.7 | 0 | Invention Example |
| 23-a-3 | 0.57 | 47 | 1.2 | 0.7 | 0 | Invention Example |
| 23-b-0 | 0.76 | 40 | 1.1 | 0.7 | 0 | Invention Example |
| 23-b-1 | 0.57 | 41 | 1.0 | 0.6 | 0 | Invention Example |
| 23-b-2 | 0.56 | 41 | 1.1 | 0.6 | 0 | Invention Example |
| 23-b-3 | 0.56 | 41 | 1.1 | 0.6 | 0 | Invention Example |
| 23-c-0 | 0.76 | 35 | 1.0 | 0.6 | 0 | Invention Example |
| 23-c-1 | 0.55 | 34 | 1.0 | 0.5 | 0 | Invention Example |
| 23-c-2 | 0.54 | 31 | 0.9 | 0.6 | 0 | Invention Example |
| 23-c-3 | 0.54 | 32 | 1.0 | 0.6 | 0 | Invention Example |

The invention claimed is:

1. A grain-oriented electrical steel sheet having a chemical composition comprising C: not more than 0.005 mass %, Si: 2.0 to 5.0 mass %, Mn: 0.01 to 0.30 mass % and the residue being Fe and inevitable impurity, and a secondary recrystallization structure that has an average diameter value of crystal grains equivalent to a circle of 10 to 100 mm, an average value of an aspect ratio represented by (length in the rolling direction)/(length in a direction perpendicular to the rolling direction) of less than 2.0, and a standard deviation of the aspect ratio of not more than 1.0.

2. The grain-oriented electrical steel sheet according to claim 1, wherein the standard deviation of the aspect ratio of the crystal grains is not more than 0.7.

3. The grain-oriented electrical steel sheet according to claim 1, wherein a total area ratio of crystal grains having a diameter equivalent to a circle of less than 2 mm is not more than 1%.

4. The grain-oriented electrical steel sheet according to claim 1, wherein the steel sheet contains one or more selected from Ni: 0.01 to 1.00 mass %, Sb: 0.005 to 0.50 mass %, Sn: 0.005 to 0.50 mass %, Cu: 0.01 to 0.50 mass %, Cr: 0.01 to 0.50 mass %, P: 0.005 to 0.50 mass %, Mo: 0.005 to 0.10 mass %, Ti: 0.001 to 0.010 mass %, Nb: 0.001 to 0.010 mass %, V: 0.001 to 0.010 mass %, B: 0.0002 to 0.0025 mass %, Bi: 0.005 to 0.50 mass %, Te: 0.0005 to 0.010 mass % and Ta: 0.001 to 0.010 mass % in addition to the above chemical composition.

5. A method for producing the grain-oriented electrical steel sheet according to claim 1 comprising a series of processes of:

heating a steel slab having a chemical composition comprising C: 0.02 to 0.10 mass %, Si: 2.0 to 5.0 mass %, Mn: 0.01 to 0.30 mass %, sol. Al: 0.01 to 0.04 mass %, N: 0.004 to 0.020 mass %, one or two selected from S and Se: 0.002 to 0.040 mass % in total and the residue being Fe and inevitable impurity to not lower than 1250° C.; and subjecting the steel slab to hot rolling, a single cold rolling or two or more cold rollings including an intermediate annealing therebetween to provide a cold-rolled sheet with a final sheet thickness, primary recrystallization annealing combined with decarburization annealing, and finish annealing, characterized in that the steel slab has a content ratio of sol. Al to N (sol. Al/N) and a final sheet thickness d (mm) satisfying the following equation (1):

$$4d+0.80<\text{sol. Al/N}<4d+1.50 \quad (1),$$

and the finish annealing is conducted by keeping the sheet at a temperature zone of higher than 850° C. but not higher than 950° C. in a heating process for 5 to 200 hours, subsequently reheating or descending the temperature once to not higher than 700° C. followed by reheating, heating the sheet in a temperature zone from 950 to 1050° C. at a heating rate of 5 to 30° C./hr, and further conducting a purification treatment of keeping a temperature of not lower than 1100° C. for not less than 2 hours; thereby producing the grain oriented electrical steel sheet of claim 1.

6. The method for producing a grain-oriented electrical steel sheet according to claim 5, wherein the steel sheet is heated in a zone of 500 to 700° C. of the heating process in the primary recrystallization annealing at a heating rate of not less than 50° C./s.

7. The method for producing a grain-oriented electrical steel sheet according to claim 5, wherein the steel slab contains one or more selected from Ni: 0.01 to 1.00 mass %, Sb: 0.005 to 0.50 mass %, Sn: 0.005 to 0.50 mass %, Cu: 0.01 to 0.50 mass %, Cr: 0.01 to 0.50 mass %, P: 0.005 to 0.50 mass %, Mo: 0.005 to 0.10 mass %, Ti: 0.001 to 0.010 mass %, Nb: 0.001 to 0.010 mass %, V: 0.001 to 0.010 mass %, B: 0.0002 to 0.0025 mass %, Bi: 0.005 to 0.50 mass %, Te: 0.0005 to 0.010 mass % and Ta: 0.001 to 0.010 mass % in addition to the above chemical composition.

8. The method for producing a grain-oriented electrical steel sheet according to claim 5, wherein a magnetic domain subdividing treatment is performed in any of steps after the cold rolling to obtain the final sheet thickness.

9. The method for producing a grain-oriented electrical steel sheet according to claim 8, wherein the magnetic domain subdividing treatment is conducted by irradiating an electron beam or a laser beam onto a surface of the steel sheet after flattening annealing.

10. The grain-oriented electrical steel sheet according to claim 2, wherein a total area ratio of crystal grains having a diameter equivalent to a circle of less than 2 mm is not more than 1%.

11. The grain-oriented electrical steel sheet according to claim 2, wherein the steel sheet contains one or more selected from Ni: 0.01 to 1.00 mass %, Sb: 0.005 to 0.50 mass %, Sn: 0.005 to 0.50 mass %, Cu: 0.01 to 0.50 mass %, Cr: 0.01 to 0.50 mass %, P: 0.005 to 0.50 mass %, Mo: 0.005 to 0.10 mass %, Ti: 0.001 to 0.010 mass %, Nb: 0.001 to 0.010 mass %, V: 0.001 to 0.010 mass %, B: 0.0002 to 0.0025 mass %, Bi: 0.005 to 0.50 mass %, Te: 0.0005 to 0.010 mass % and Ta: 0.001 to 0.010 mass % in addition to the above chemical composition.

12. The grain-oriented electrical steel sheet according to claim 3, wherein the steel sheet contains one or more selected from Ni: 0.01 to 1.00 mass %, Sb: 0.005 to 0.50 mass %, Sn: 0.005 to 0.50 mass %, Cu: 0.01 to 0.50 mass %, Cr: 0.01 to 0.50 mass %, P: 0.005 to 0.50 mass %, Mo: 0.005 to 0.10 mass %, Ti: 0.001 to 0.010 mass %, Nb: 0.001 to 0.010 mass %, V: 0.001 to 0.010 mass %, B: 0.0002 to 0.0025 mass %, Bi: 0.005 to 0.50 mass %, Te: 0.0005 to 0.010 mass % and Ta: 0.001 to 0.010 mass % in addition to the above chemical composition.

13. The grain-oriented electrical steel sheet according to claim 10, wherein the steel sheet contains one or more selected from Ni: 0.01 to 1.00 mass %, Sb: 0.005 to 0.50 mass %, Sn: 0.005 to 0.50 mass %, Cu: 0.01 to 0.50 mass %, Cr: 0.01 to 0.50 mass %, P: 0.005 to 0.50 mass %, Mo: 0.005 to 0.10 mass %, Ti: 0.001 to 0.010 mass %, Nb: 0.001 to 0.010 mass %, V: 0.001 to 0.010 mass %, B: 0.0002 to 0.0025 mass %, Bi: 0.005 to 0.50 mass %, Te: 0.0005 to 0.010 mass % and Ta: 0.001 to 0.010 mass % in addition to the above chemical composition.

14. The method for producing a grain-oriented electrical steel sheet according to claim 6, wherein the steel slab contains one or more selected from Ni: 0.01 to 1.00 mass %, Sb: 0.005 to 0.50 mass %, Sn: 0.005 to 0.50 mass %, Cu: 0.01 to 0.50 mass %, Cr: 0.01 to 0.50 mass %, P: 0.005 to 0.50 mass %, Mo: 0.005 to 0.10 mass %, Ti: 0.001 to 0.010 mass %, Nb: 0.001 to 0.010 mass %, V: 0.001 to 0.010 mass %, B: 0.0002 to 0.0025 mass %, Bi: 0.005 to 0.50 mass %, Te: 0.0005 to 0.010 mass % and Ta: 0.001 to 0.010 mass % in addition to the above chemical composition.

15. The method for producing a grain-oriented electrical steel sheet according to claim 6, wherein a magnetic domain subdividing treatment is performed in any of steps after the cold rolling to obtain the final sheet thickness.

16. The method for producing a grain-oriented electrical steel sheet according to claim 7, wherein a magnetic domain subdividing treatment is performed in any of steps after the cold rolling to obtain the final sheet thickness.

17. The method for producing a grain-oriented electrical steel sheet according to claim 14, wherein a magnetic domain subdividing treatment is performed in any of steps after the cold rolling to obtain the final sheet thickness.

18. The method for producing a grain-oriented electrical steel sheet according to claim 15, wherein the magnetic domain subdividing treatment is conducted by irradiating an electron beam or a laser beam onto a surface of the steel sheet after flattening annealing.

19. The method for producing a grain-oriented electrical steel sheet according to claim 16, wherein the magnetic domain subdividing treatment is conducted by irradiating an electron beam or a laser beam onto a surface of the steel sheet after flattening annealing.

20. The method for producing a grain-oriented electrical steel sheet according to claim 17, wherein the magnetic domain subdividing treatment is conducted by irradiating an electron beam or a laser beam onto a surface of the steel sheet after flattening annealing.

* * * * *